United States Patent [19]

Givler

[11] 4,039,992

[45] Aug. 2, 1977

[54] NON-CREEP THERMOSTAT CONSTRUCTION

[75] Inventor: Omar R. Givler, North Canton, Ohio

[73] Assignee: Portage Electric Products, Inc., North Canton, Ohio

[21] Appl. No.: 659,500

[22] Filed: Feb. 19, 1976

[51] Int. Cl.[2] ..... H01H 37/54

[52] U.S. Cl. ..... 337/365; 337/368; 337/372

[58] Field of Search ..... 337/365–368, 337/372, 380, 89

[56] References Cited

U.S. PATENT DOCUMENTS

| | | | |
|---|---|---|---|
| 3,171,925 | 3/1965 | Malone et al. | 337/89 |
| 3,256,413 | 6/1966 | Mertler | 337/380 |
| 3,443,259 | 5/1969 | Wehl et al. | 337/368 |
| 3,577,111 | 5/1971 | Nardulli | 337/372 |
| 3,851,288 | 11/1974 | Stoll | 337/372 |

*Primary Examiner*—William H. Beha, Jr.

*Attorney, Agent, or Firm*—McAulay, Fields, Fisher & Goldstein

[57] ABSTRACT

A Bimetal strip, having a formed, snap-over portion is mounted within the body of a thermostat on two knife edges, each knife edge being adjacent the juncture of the formed portion with the remainder of the bimetallic strip. The combination provides for making and breaking of the circuit by the thermostat, with no creep in either direction.

4 Claims, 6 Drawing Figures

NON-CREEP THERMOSTAT CONSTRUCTION

BACKGROUND OF THE INVENTION

Many developments in the field of bimetallic thermostats have attempted to deal with and avoid creep in the thermostat. A particular method of accomplishing this has been through the use of a formed, dish-shaped portion within the bimetal. Because the dish-shaped portion actually snaps from one position to another at the disired temperature, this forming technique has avoided many of the problems of creeping in bimetallic thermostats. The use of such dish-shaped portions is shown, for example, in U.S. Pats. Nos. 2,820,870 and 3,443,259.

However, many bimetallic thermostats require a rectangular strip for proper functioning. The formed, dish-shaped member can be, and usually is, provided at the center of this rectangular strip. While the problems of creep are minimized with such a construction, they are not entirely avoided. In fact, various adjustments can be made in order to avoid creep, but the creep is only avoided on opening of the contact, or on closing of the contact, and not on both.

Generally, in a construction of the type described, the bimetallic strip, with the dish-shaped portion, is placed within a rectangular casing so as to act against an arm on which a contact is mounted in order to make and break the circuit contact. Because of the construction of the bimetallic strip, the "tails," those portions of the bimetallic strip beyond the dish-shaped portion, will begin to press against the bottom of the casing as the temperature rises. Even prior to snapping of the dish-shaped portion, the edges of that portion will begin to bear against the contact arm and moves it slightly from the fixed contact which it abuts when contact is made. This is the type of creep which it is desired to avoid with the construction of the present invention.

SUMMARY OF THE INVENTION

In accordance with the present invention, a modification is made to the standard casing of a bimetallic thermostat which employs a rectangular bimetal strip, the latter having a central, formed, dish-shaped portion. The construction modification involves the placement of two knife edges on the bottom of the casing, opposite the movable arm, these knife edges acting to support the rectangular, bimetal strip. The knife edges are so placed as to support the strip on the flat or planar portion, in proximity to the rim of the dished portion. By supporting the rectangular bimetal at these points, the tails of the bimetal can move downwardly, as the temperature rises, without sufficiently contacting the base of the casing to begin movement of the contact arm, prior to snap-over of the dished portion.

DESCRIPTION OF THE PREFERRED EMBODIMENTS

Figure 1:
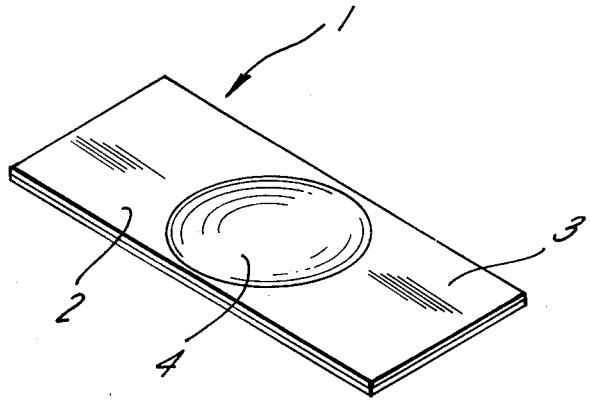
FIG. 1 is a perspective view of a rectangular, bimetal strip having a central dished portion.

Referring to the drawings, a bimetal strip 1 having planar portions, or tails, 2 and 3 is illustrated. The central portion of the rectangular strip 1 is formed, as at 4, to provide a dished portion. This dished portion 4 is provided so that it snaps when the predetermined temperature is reached, rather than gradually approaching a position opposite its original position. Such a formed, dished portion is well known in the art.

Figure 2:
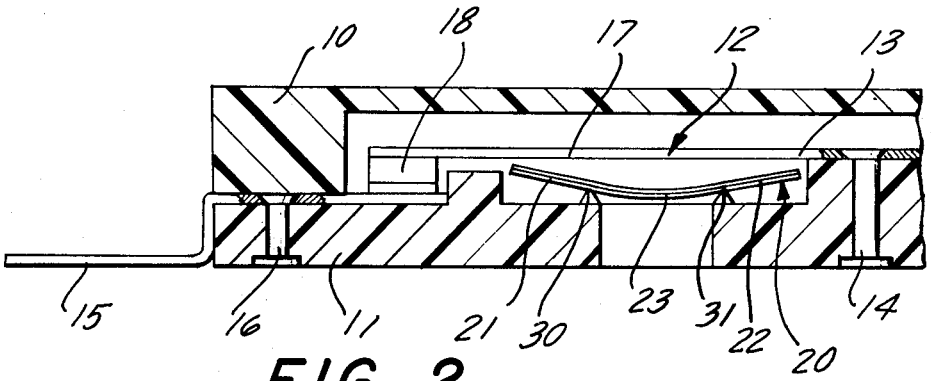
FIG. 2 is a sectional view of a thermostat, showing the position of a bimetal strip, as that shown in FIG. 1, at ambient temperature.

A bimetal thermostat, including the casing, is illustrated in FIG. 2. Such a thermostat includes an upper casing portion 10 and a lower casing portion 11, together forming a cavity 12 within which the operating portions of the thermostat are placed. Further standard portions of the thermostat include a first contact 13 which is rigidly held to the thermostat casing as by rivet 14 and a second contact 15 which is rigidly held to the casing as by rivet 16. Contact 12 includes a flexible arm 17 to which is attached a contact member 18. In the position shown in FIG. 2, contact member 18 abuts a portion of contact 15 so as to complete a circuit. Also within the cavity 12 is a bimetal strip 20 of the type illustrated in FIG. 1. This bimetal strip includes tails 21 and 22 and a central, formed, dished portion 23.

The bimetal strip 20 is supported within the cavity 12 by knife edges 30 and 31. As illustrated, the knife edges support the bimetal strip 20 on the tails or planar portions 21 and 22 in proximity to the edge of the dished portion 23.

The thermostat, as illustrated in FIGS. 2 through 6, is one where contact is made at a low temperature, but contact is broken at a preselected, high temperature, because of movement of the bimetal strip 20. In the form shown in FIG. 2, the dished portion faces away from the flexible arm 17, and the tails 21 and 22 point upwardly, but do not contact the flexible arm 17.

Figure 3:
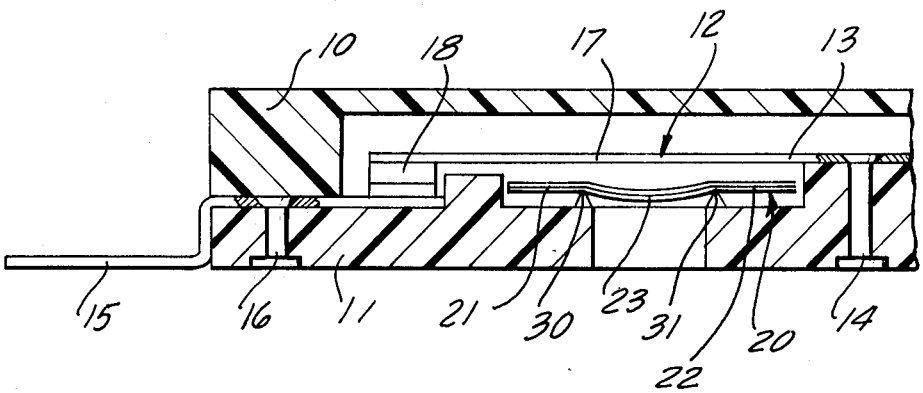
FIG. 3 is a view similar to that of FIG. 2, showing the position of the bimetal strip at a higher temperature.
Figure 4:
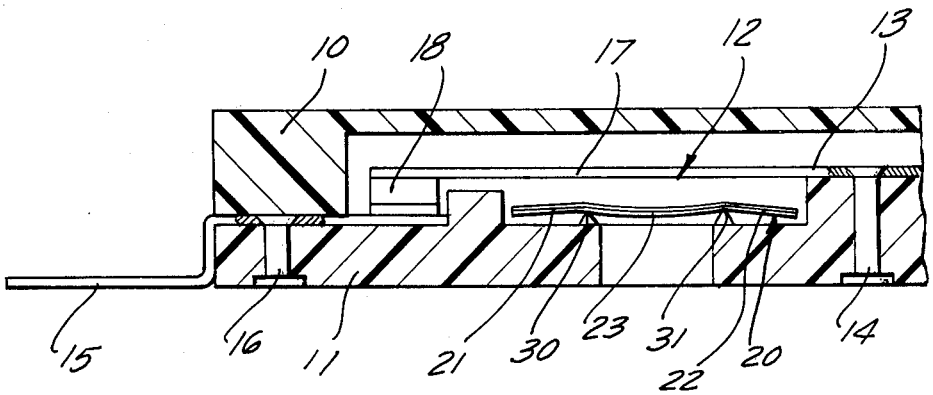
FIG. 4 is a view similar to that of FIG. 2 showing the bimetal strip at a still higher temperature.
Figure 5:
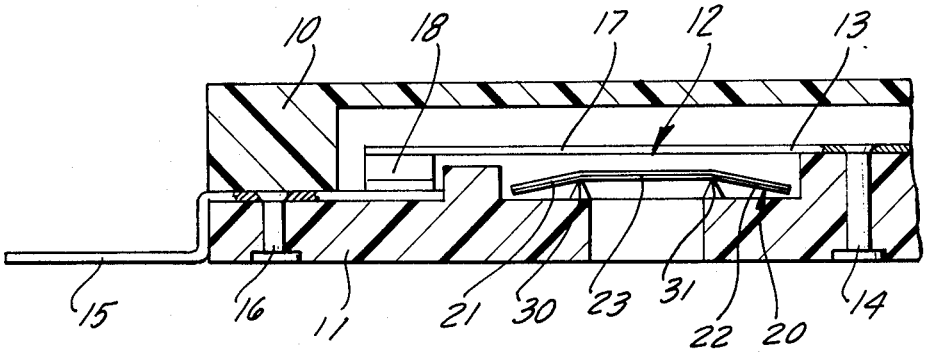
FIG. 5 is a view similar to that of FIG. 2 showing the position of the bimetal strip just prior to operation of the dished portion.

As the temperature rises, the tails 21 and 22 first approach a nearly horizontal position, as illustrated in FIG. 3. Further increases in temperature will cause the tails to point downwardly, first to the degree illustrated in FIG. 4, and then to the degree illustrated in FIG. 5. It will also be appreciated, from a view of FIG. 5, that the formed, dished portion 23 has flattened in FIG. 5. It will be appreciated that absent the knife edges 30 and 31, the bimetal strip 20 would be raised off of the base of the casing, at some point between the illustrations of FIS. 4 and 5. As the temperature continued to rise, there would be an increased bowing of the bimetal strip 20, such that the unsnapped dished portion would begin to bear against the flexible arm 17. While this might not totally break the contact between contact member 18 and contact 15, there would no longer be a firm contact. It is this creep action which is avoided by the structure of the present invention.

Figure 6:
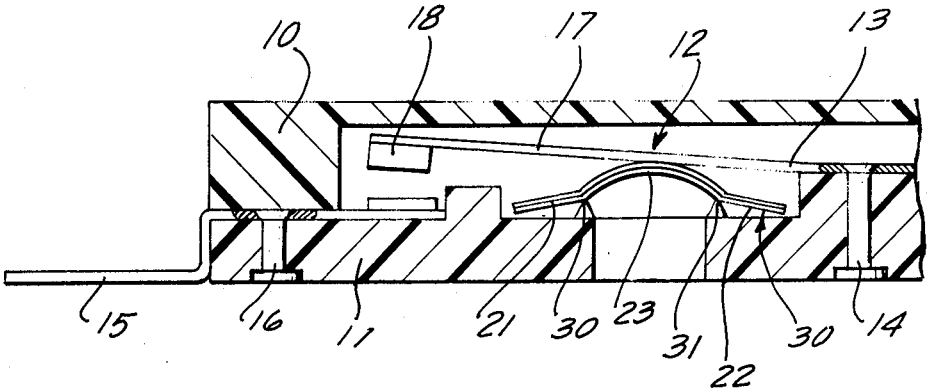
FIG. 6 is a view similar to FIG. 2 showing the position of the bimetal strip and the contact arm, after snap-over of the dished portion of the bimetal strip.

In FIG. 6, the position of bimetal 20, after snapping of the formed, dished portion 23, is shown, In this position, the tails or planar portions 21 and 22 may rest on the base 11 of the thermostat casing, but this is no longer important. The formed, dished portion 23 has snapped to a point that it forces flexible arm 17 upwardly, the upward movement of arm 17 being sufficient to break the contact between contact member 18 and contact 15, thus stopping the flow of current.

Because of the construction shown in FIGS. 2 through 5, creep is obviously avoided in the opposite direction, as well. It will be appreciated that absent knife edges 30 and 31, when the formed, dished portion 23 snaps backward, away from the position of FIG. 5, there will still be a bowing of the bimetal strip 20 in the general form shown in FIG. 5. This can, and frequently does, absent the knife edges, cause an imperfect contact of contact member 18 with contact 15 at the point when the circuit is again to be completed. Because of the position occupied by the bimetal strip 20, with its support by the knife edges 30 and 31, such creeping on closing of the contact is also avoided.

It will also be appreciated that the specific form and type of operation illustrated in the drawings is not limiting, but is merely illustrative of the use of a bimetal strip, having a central, formed dished portion which snaps over at a preselected temperature in order to move a contact member from a first position to a second position. The important feature of this development is the use of knife edges to support the bimetal strip, those knife edges being placed in proximity to the formed, dished portion.

Thus, the invention should not be considered as limited to the specific embodiment shown and described, but only as limited in the appended claims.

I claim:

1. In a thermostatic element having a case, a first contact, a second contact including a flexible arm and a contact member to contact said first contact, said flexible arm being movable so as to place said contact member in a first position abutting said first contact and in a second position away from said first contact, movement of said flexible arm being controlled by a bimetal strip having a formed, dished, snap-over portion, the improvement which comprises a pair of knife edges, placed opposite said flexible arm, to provide the sole support for said bimetal strip.

2. The improvement of claim 1 wherein said knife edges are on the base of said thermostat casing.

3. The improvement of claim 1 wherein said knife edges support said bimetal strip on the planar portions of said strip in proximity to said formed, dished portions.

4. The improvement of claim 1 wherein said formed dished portion is at the center of said bimetal strip.

* * * * *